US009663748B2

(12) United States Patent
Silvernail et al.

(10) Patent No.: US 9,663,748 B2
(45) Date of Patent: May 30, 2017

(54) FREESTANDING DETERGENT COMPOSITION NOT REQUIRING AN AUTOMATED DISPENSER

(71) Applicant: ECOLAB USA INC., St. Paul, MN (US)

(72) Inventors: Carter M. Silvernail, Burnsville, MN (US); Erik C. Olson, Savage, MN (US); Michael E. Besse, Golden Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 115 days.

(21) Appl. No.: 14/519,972

(22) Filed: Oct. 21, 2014

(65) Prior Publication Data

US 2015/0038390 A1 Feb. 5, 2015

Related U.S. Application Data

(62) Division of application No. 13/594,531, filed on Aug. 24, 2012, now Pat. No. 8,888,924.

(51) Int. Cl.

| | |
|---|---|
| ***C11D 7/06*** | (2006.01) |
| ***C11D 7/14*** | (2006.01) |
| ***C11D 7/26*** | (2006.01) |
| ***C11D 17/00*** | (2006.01) |
| ***C11D 17/04*** | (2006.01) |
| ***A47L 15/44*** | (2006.01) |

(52) U.S. Cl.

CPC ..... *C11D 7/06* (2013.01); *A47L 15/4436* (2013.01); *C11D 7/14* (2013.01); *C11D 7/261* (2013.01); *C11D 7/268* (2013.01); *C11D 17/0052* (2013.01); *C11D 17/041* (2013.01)

(58) Field of Classification Search

CPC ... C11D 17/042; C11D 17/045; C11D 17/044; C11D 17/0078

See application file for complete search history.

(56) References Cited

U.S. PATENT DOCUMENTS

| | | | | |
|---|---|---|---|---|
| 6,548,473 | B1 * | 4/2003 | Jacques Kamiel Thoen | C11D 17/0078 134/25.2 |
| 2009/0196897 | A1 * | 8/2009 | Gladfelter | C11D 1/66 424/405 |
| 2010/0125046 | A1 * | 5/2010 | Denome | C11D 17/045 510/220 |
| 2012/0159718 | A1 * | 6/2012 | Catlin | C11D 17/045 8/137 |

* cited by examiner

*Primary Examiner* — Gregory Webb

(74) *Attorney, Agent, or Firm* — McKee, Voorhees & Sease, PLC

(57) ABSTRACT

A solid controlled release composition according to the present invention includes at least one cellulosic material, water, at least one active ingredient, and optionally at least one of a saccharide, sugar alcohol or salt. The active ingredient can be a polycarboxylic acid.

8 Claims, 1 Drawing Sheet

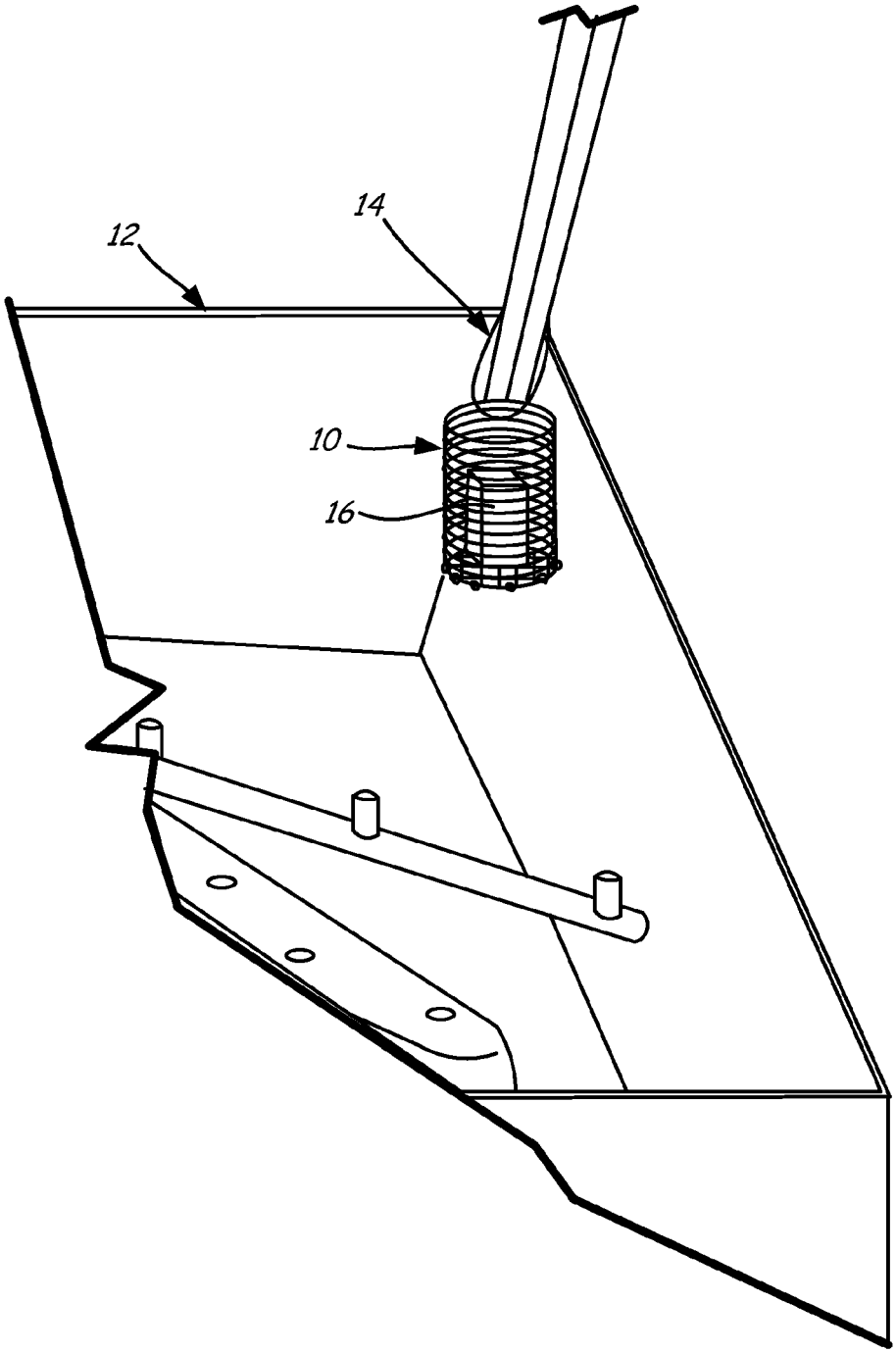
12
14
10
16

FREESTANDING DETERGENT COMPOSITION NOT REQUIRING AN AUTOMATED DISPENSER

RELATED CASES

This application is a divisional of U.S. patent application Ser. No. 13/594,531, filed Aug. 24, 2012, now U.S. Pat. No. 8,888,924, the entire disclosure of which is incorporated herein by reference in its entirety for all purposes.

TECHNICAL FIELD

The present invention is related to the field of dishwashing or warewashing compositions. In particular, the present invention is related to a controlled release composition which provides sustained release or controlled release of an ingredient.

BACKGROUND

Conventional detergents used in the vehicle care, food and beverage (e.g., the dairy, cheese, sugar, meat, food, and brewery and other beverage industries), warewashing, and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to remove soils and to sequester metal ions such as calcium, magnesium and iron.

In particular, NTA, EDTA or polyphosphates such as sodium tripolyphosphate and their salts are used in detergents because of their ability to solubilize preexisting inorganic salts and/or soils. When calcium, magnesium and iron salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. In the food and beverage industry, the calcium carbonate residue can affect the acidity levels of foods and hinder proper cleaning. The ability of NTA, EDTA and polyphosphates to remove metal ions facilitates the detergency of the solution by preventing hardness precipitation, assisting in soil removal and/or preventing soil redeposition into the wash solution or wash water. Furthermore, phosphates function at substoichiometric concentrations, dispersing minerals, passivating metal surfaces, and inhibiting metal corrosion.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can replace the properties of phosphorous-containing compounds such as phosphates, phosphonates, phosphites, and acrylic phosphinate polymers, as well as non-biodegradable aminocarboxylates such as NTA and EDTA.

SUMMARY

One embodiment provides a method of cleaning wares which includes washing wares in a wash tub of an institutional warewashing machine or a consumer dishwashing machine with at least one cycle that includes at least one wash cycle and at least one rinse cycle. Prior to beginning the cycle, a solid controlled release composition is provided in the wash tub and a detergent composition is provided in a dispenser of the warewashing or dishwashing machine. The solid composition includes at least one cellulosic material, water, at least one active ingredient, and optionally a saccharide, sugar alcohol, alkali metal or alkali earth metal salt or a combination thereof. During the wash cycle, the wares in the wash tub are contacted with an aqueous mixture of the at least one active ingredient and the at least one alkalinity source of the detergent.

Another embodiment provides a system for cleaning wares which includes a solid controlled release composition and a discrete detergent composition. The solid controlled release composition has a substantially homogenous composition and consists essentially of at least one cellulosic material, water, at least one anti-scalant, dispersant or threshold agent, and optionally a saccharide, sugar alcohol, alkali metal or alkali earth metal salt or a combination thereof. The anti-scalant, dispersant or threshold agent may be a polycarboxylic acid.

A further embodiment provides a solid composition consisting essentially of at least one cellulosic material, water, at least one polycarboxylic acid, and optionally a saccharide, sugar alcohol, salt or a combination thereof. The solid composition is essentially free of an alkalinity source.

A still further embodiment provides a cleaning system comprising a solid controlled release composition and a holder configured to hold the solid composition and configured to be secured to a wash tub of a warewashing or dishwashing machine. The holder can comprise a mesh, basket, cage, net cartridge or case.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The Sole FIGURE is a perspective view an example holder for a solid controlled release tablet located inside an institutional warewashing machine.

DETAILED DESCRIPTION

The present invention relates to solid controlled release compositions that dissolve or erode over time when contacted with water to release at least one active ingredient. The solid controlled release composition can be used in combination with a separate, discrete detergent composition and may boost the performance of the detergent composition. The solid controlled release composition may be packaged with the detergent composition. Alternatively, the solid controlled release composition and the detergent composition may be packaged and provided separately. The solid controlled release composition can be applied in any environment where it is desirable to remove and/or prevent redeposition of soils, to prevent the formation, growth and precipitation of magnesium, calcium, and iron hardness, disperse food soil and mineral salts, such as calcium carbonate and prevent and/or reduce corrosion. The solid controlled release composition may be suitable for both industrial and consumer applications including, but not limited to institutional warewashing, consumer dishwashing, laundering, and food and beverage applications, hard surface cleaning, clean in place (CIP) systems, vehicle care, healthcare. Methods of using the solid controlled release compositions are also provided. For ease of description, the solid controlled release composition will be described with use in a warewashing machine. However, one skilled in the art will recognize that the composition may also be used in a consumer dishwashing machine.

Solid Controlled Release Composition

The solid controlled release composition can be a free standing solid composition, such as but not limited to a solid block, tablet, or capsule. The solid controlled release compositions may be present for the duration of a cycle of a warewashing or dishwashing machine. A cycle includes at least one wash cycle and at least one rinse cycle with the number of wash and rinse cycles and the duration and temperature of each wash and rinse cycle dependent on the specific cycle settings. An automated dispenser or delivery system is not required to dispense the solid controlled release composition during a specified stage of a cycle, such as during the wash cycle. That is, no system or mechanism controls when the solid controlled release composition is added to the cycle. Instead, the solid controlled release composition can be placed directly inside the wash tub of a warewashing machine at the start of the cycle (e.g., before the fill and/or wash cycle) and may be present throughout the cycle. The solid controlled release composition can be available for contact with water through the entire cycle. When contacted water, the solid controlled release composition will dissolve or erode and the contents of the solid controlled release composition will mix with the water to form an aqueous mixture or solution. For example, the solid control release composition will dissolve or erode when contacted with water from the wash cycle or rinse cycle. Water from a source other than water from the wash or rinse cycle may also be applied to the solid control release composition to dissolve or erode the composition or combinations of water sources may be used. The controlled release solid may be placed above or below the water line in the wash tub. Preferably, the controlled release solid composition is placed above the water line in the wash tub.

The solid controlled release compositions generally include at least one cellulosic material, water, and at least one active ingredient. The solid controlled release composition may optionally include at least one saccharide, sugar alcohol, salt or a combination thereof. In one example, the solid controlled release composition consists essentially of at least one cellulosic material, water, at least one active ingredient and optionally at least one saccharide, sugar alcohol or salt. The solid controlled release composition can have a substantially homogenous composition and can be in block, tablet or capsule form.

Suitable cellulosic materials include carboxymethylcellulose (CMC), hydroxyethylcellulose (HEC), hydroxypropylcellulose (HPC), hydroxypropyl methylcelluslose (HPMC), methylcellulose (MC), celluslose acetate, and cellulose triacetate. The cellulosic material can function as a solidification agent and as a slow release agent. The cellulosic material can improve the stability of the solid controlled release composition, preventing or reducing swelling and growth. Swelling and growth of the solid controlled release composition are not desirable because changing the size and/or shape of the solid controlled release composition may interfere with packaging, storage and use. The cellulosic material also functions to regulate the amount of active ingredient that dissolves or diffuses into the water. The amount of active ingredient released is adjusted by modifying the components of the free standing composition.

Suitable concentrations for cellulosic material in the solid controlled release composition can be between about 5% and about 90% by weight of the solid controlled release composition. Further suitable concentrations of cellulosic material in the solid controlled release compositions can be between about 10% and about 75% by weight of the solid controlled release composition. Still further suitable concentrations of cellulosic material in the solid controlled release compositions can be between about 20% and about 75% by weight of the solid controlled release composition. A solid controlled release composition having too high of a cellulosic material content may prevent a suitable amount of active ingredient from being added to the composition while a composition having not enough cellulosic material may not form a solid.

Water may be independently added to the solid controlled release composition or may be provided in the composition as a result of its presence in an aqueous material that is added to the detergent composition. For example, materials added to the solid controlled release composition may include water or may be prepared in an aqueous premix. Typically, water is introduced into the composition to provide a desired viscosity for processing prior to solidification and to provide a desired rate of solidification. The water may also be present as a processing aid and may be removed or become water of hydration. The water may be added separately as deionized water, softened water, or hard water.

The amount of water in the resulting controlled release composition will depend on whether the solid controlled release composition is processed through forming techniques or casting (solidification occurring within a container) techniques. In general, when the components are processed by forming techniques, the solid controlled release composition may include a smaller amount of water for solidification compared with the casting techniques. Suitable concentrations of water include between about 0.5% and about 60% by weight of the solid controlled release composition. Further suitable concentrations of water include between about 5% and about 45% by weight of the solid controlled release composition. Still further suitable concentrations of water include between about 10% and about 35% by weight of the solid controlled release composition.

The solid controlled release composition further includes at least one active ingredient. The "active ingredient" can include a material that when dispersed or dissolved in a use and/or concentrate solution, such as an aqueous solution, provides a beneficial property in a particular use. Examples of active ingredients include but are not limited to chelants, corrosion inhibitors, anti-scale agents, dispersants, threshold inhibitors, crystal modifiers, enzymes, surfactants, and alkaline sources. Anti-scale agents, dispersants and threshold inhibitors prevent or reduce calcium carbonate deposition and/or build-up on wares.

Suitable anti-scale agents, dispersants and threshold inhibitors include polycarboxylic acid homopolymers, polycarboxylic acid copolymers, polycarboxylic acid terpolymers, hydrophobically modified polycarboxylic acid polymers, phosphonates, phosphonocarboxylic acid polymers, phosphinocarboxylic acid polymers, sulfonated polycarboxylic acid polymers, polysaccharides and sugar alcohols comprising more than one polycarboxylic acid monomer and optionally a sulfonated, hydrophobic, or amide containing monomer. Suitable polycarboxylic acid homopolymers, copolymers, and terpolymers may comprise monomers including, but not limited to aliphatic, branched, cyclic, aromatic, nonionic, sulfonated, monocarboxylic acids and dicarboxylic acids. Examples of suitable monomers used to prepare polycarboxylic acid homopolymers, copolymers or terpolymers include acrylic acid, methacrylic acid, maleic acid, maleic anhydride, itaconic acid, alpha-phenyl acrylic acid, sorbic acid, cinnamic acid, unsaturated polyethylene glycol, substituted, unsaturated polyethylene glycol, fumaric acid, crotonic acid, C1-C6 alkyl esters of acrylic acid, C1-C6 alkyl esters of methacrylic acid, acrylamides, c1-c6 alkyl acrylamides, n-alkyl substituted acrylamides, mono- and dimethyl maleate, mono- and dimethyl itaconate, allyl acetates, methallyl acetates, allyl propionates, methallyl propionates, allyl valerates, methallyl valerates, styrene, vinyl acetate, diisobutylene napthalene, substituted styrene, substituted naphthalene, sulfonated styrene, 2-acrylamido-2-methylpropane sulfonic acid (AMPS), allyl sulfonate, methallyl sulfonate, sulfophenylmethallylether, allyloxybenzene sulfonic acid, C1-C6 alkyl vinyl ether and alkali metal and ammonium salts thereof. Particularly preferred are polymers comprising acrylic acid, maleic acid, methacrylic acid, ethylacrylate, vinyl acetate, itaconic acid, 2-acrylamido-2-methyl propane sulfonic acid (AMPS), allyl sulfonate, methallyl sulfonate, styrene, sulfonated styrene, allyloxybenzene sulfonic acids and alkali metal and ammonium salts thereof. The particularly preferred polymers may comprise additional hydrophobic or hydrophilic monomers. Suitable polymers include those having a molecular weight between 500-300,000 g/mol. Particularly suitable polymers include those having a molecular weight between 1,000-100,000 g/mol. More particularly, polymers include those having a molecular weight between 1,000-50,000 g/mol.

Examples of particularly suitable polymers include commercially available polycarboxylic acid polymers including, but not limited to, Acumer 1000, Acusol 425N, Acusol 445, Acusol 441, Acusol 929, Acusol 460, Acusol 470N, Acusol 448, Acusol 505, Acumer 2000, Acumer 2100, Acumer 3100, Acusol OP305, Optidose 4210, Acusol 430, Acusol 587 and Acusol 586 available from Dow Chemical. Other particularly suitable polycarboxylic acids include Belclene 283, Belclene 200, Belclene 810, Belsperse 161 available from BWA Water Additives; Aquatreat 260, Aquatreat 545, Aquatreat 546, Aquatreat AR801, Aquatreat 978, Aquatreat AR-4, Alcosperse 125, Alcosperse 240, Alcosperse 149, Alcosperse 408, Alcosperse 459N, Alcosperse 465, Alcosperse 602N, Alcosperse 410, Alcosperse 420, Alcosperse 747, Alcosperse 325, Alcosperse 729, Alcoguard 7100, Versaflex One, and Versaflex SI available from AkzoNobel; and Gantrez S-95, Jaypol HS75, Jaypol HN70, Jaypol S71 and Jaypol S72 available from Ashland, Inc. Suitable concentrations of anti-scalants, dispersants and threshold agents include between about 0.1% and about 40% by weight of the solid controlled release composition. Further suitable concentrations of anti-scalants, dispersants and threshold agents include between about 1% and about 30% by weight of the solid controlled release composition. Still further suitable concentrations of anti-scalants, dispersants and threshold agents include between about 5% and about 20% by weight of the solid controlled release composition.

The solid controlled release composition can optionally include at least one saccharide, sugar alcohol, salt or combination thereof. Suitable saccharides for use with embodiments of the present invention include monosaccharides, disaccharides and polysaccharides, and in particular mono-, di- and polysaccharides containing 3 or more saccharide units. Suitable saccharides include, but are not limited to glucose, fructose, lactulose galactose, raffinose, trehalose, sucrose, maltose, turanose, cellobiose, raffinose, melezitose, maltriose, acarbose, stachyose, ribose, arabinose, xylose, lyxose, deoxyribose, psicose, sorbose, tagatose, allose, altrose, mannose, gulose, idose, talose, fucose, fuculose, rhamnose, sedohepulose, octuse, nonose, erythrose, theose, amylose, amylopectin, pectin, inulin, modified inulin, potato starch, modified potato starch, corn starch, modified corn starch, wheat starch, modified wheat starch, rice starch, modified rice starch, cellulose, modified cellulose, dextrin, dextran, maltodextrin, cyclodextrin, glycogen and oligiofructose, sodium carboxymethylcellulose, linear sulfonated α-(1,4)-linked D-glucose polymers, γ-cyclodextrin and the like. Examples of particularly suitable saccharide based sugars include, but are not limited to sucrose, fructose, inulin, lactulose, maltose, potato starch, modified potato starch, wheat starch, modified wheat starch, cellulose, modified cellulose, rice starch, modified rice starch, dextrin, dextran, cyclodextrin, inulin and combinations thereof. Examples of more particularly suitable saccharide based sugars include but are not limited to sucrose, glucose, fructose, inulin, maltose, raffinose, xylose, amylose, modified inulin, potato starch, modified potato starch, corn starch, modified corn starch, wheat starch, modified wheat starch, rice starch, modified rice starch, cyclodextrin, maltodextrin, and oligiofructose.

Examples of suitable inulin saccharides include, but are not limited to, naturally-occurring and derivatized inulins. Derivatized inulins are modified to be further substituted at a varying number of the available hydroxyls, with alkyl, alkoxy, carboxy, and carboxyalkyl moieties, for example. Examples of particularly suitable commercially available carboxymethyl inulin-based polymers include, but are not limited to: Dequest PB 11615, Dequest PB 11620 and Dequest PB 11625, available from Solutia, Inc., St. Louis, Mo. Dequest PB 11625 is a 20% solution of carboxymethyl inulin, sodium salt, having a MW>2000.

Examples of suitable sugar alcohols include glycol, glycerine, erythritol, threitol, arabitol, xylitol, ribitol, mannitol, sorbitol, dulcitol, iditol, isomalt, malitol, polyglycitol, lactitol, polyethylene glycol and modified polyethylene glycol. Suitable modified polyethylene glycol includes polyethylene glycols may be modified to include amine, amide, carboxylic acid, or hydrophobic groups. Examples of hydrophobic groups include saturated or unsaturated functionalities including linear or branched alkyl groups, linear or branched hydroxy alkyl groups. Suitable polyethylene gycols or substituted polyethylene glycols include those having a molecular weight between 100 and 1,000,000 g/mol.

Saccharides and sugar alcohols can function to alter the release rate of the active ingredient. For example, adjusting the saccharide and/or sugar alcohol content may alter the release rate of the at least one active ingredient. The saccharides and sugar alcohols can also function as fillers. Suitable concentrations of at least one saccharide, sugar alcohol or combinations thereof include between about 0.05% and about 25% by weight of the solid controlled release composition. Further suitable concentrations include between about 0.5% and about 20% by weight of the solid controlled release composition. Still further suitable concentrations include between about 1% and about 15% by weight of the solid controlled release composition.

The solid controlled release composition can additionally or alternatively optionally include at least one salt, such as an alkali metal or alkali earth metal salt. Suitable salts include lithium, sodium, potassium, calcium, magnesium, iron, strontium, zinc, manganese, lanthanum, titanium, gallium, aluminum, cobalt, copper, molybdenum, rhenium, rhodium, scandium, tin and zirconium. Suitable metal salts include sodium, lithium, potassium salts including, but not limited to sulfates, chlorides, phosphates, acetates, nitrates, and carbonates. Particularly useful metals salts include lithium, sodium and potassium sulfates, chlorides and acetates. Salts may alter the release rate of the at least one active ingredient of the solid controlled release composition. For example, increasing the salt content may adjust the rate at which the active ingredient is released. Suitable concentrations of salt include between about 1% and about 70% by weight of the solid controlled release composition. Further suitable concentrations of salts include between about 5% and about 70% by weight of the solid controlled release composition. Still further concentrations of salt include between about 5% and about 50% by weight of the solid controlled release composition.

Detergent Composition

The current controlled release composition may be used in conjunction with a discrete detergent composition, such as an alkaline detergent composition. A suitable alkaline detergent composition can include at least one alkalinity source, such as but not limited to alkali metal hydroxides, alkali metal carbonates, alkali metal metasilicates, and alkali metal silicates, and a surfactant or a surfactant system. When the detergent is a solid, the detergent may also include water. Suitable alkalinity sources include but are not limited to sodium hydroxide, potassium hydroxide, sodium carbonate, potassium carbonate, a mixture of alkali metal hydroxides, a mixture of alkali metal carbonates, and a mixture of alkali metal hydroxide and alkali metal carbonate. The alkali metal hydroxide, alkali metal silicate, alkali metal metasilicate and/or alkali metal carbonate may be added to the detergent in any form known in the art, including as solid beads, flakes, powder, dissolved in an aqueous solution, or a combination thereof.

The alkalinity source controls the pH of the resulting use solution when water is added to the detergent. The pH of the use solution must be maintained in the alkaline range in order to provide sufficient detergency properties. In one example, the pH of the use solution is between about 7 and about 13. Particularly, the pH of the use solution is between about 9 and about 12. If the pH of the use solution is too high, for example, above 13, the use solution may be too alkaline and attack or damage the surface to be cleaned.

The alkali source of the detergent and the pH of the resulting use solution may differ depending on whether the detergent is for institutional or consumer applications. In one suitable consumer detergent, the alkalinity source consists of at least one alkali metal carbonate, alkali metal metasilicate, alkali metal silicate or combinations thereof, and the resulting use solution has a pH between about 7 and 11. Institutional detergents may have a higher pH than consumer detergents. In one suitable institutional detergent, the alkalinity source consists of at least one alkali metal hydroxide, alkali metal carbonate, alkali metal metasilicate, alkali metal silicate or combinations thereof, and the resulting use solution has a pH between about 9.5 and 13.

When the detergent is provided as a solid, the alkalinity source may also function as a hydratable salt. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable salt be completely anhydrous.

A variety of surfactants can be used in the detergent composition, including, but not limited to: anionic, nonionic, cationic, and zwitterionic surfactants. Surfactants are an optional component of the detergent composition and can be excluded from the concentrate. Exemplary surfactants that can be used are commercially available from a number of sources. For a discussion of surfactants, see Kirk-Othmer, Encyclopedia of Chemical Technology, Third Edition, volume 8, pages 900-912. When the detergent composition includes a surfactant as a cleaning agent, the cleaning agent is provided in an amount effective to provide a desired level of cleaning. The detergent composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. When a nonionic surfactant is present in the detergent composition or controlled release solid, a hydrotrope may also be present. Suitable hydrotropes include, but are not limited to sodium xylene sulfonate, sodium cumene sulfonate, alkyldiphenyloxide disulfonates, ethoxylated phenol, ethoxylated benzyl alcohol and the like. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va. A particularly suitable surfactant is D500, an ethylene oxide/propylene oxide copolymer available from BASF Corporation, Florham Park, N.J.

Examples of cationic surfactants that can be used in the detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the detergent composition include, but are not limited to: betaines, imidazolines, and propionates.

When the detergent composition is intended to be used in an automatic dishwashing or warewashing machine, the surfactants selected, if any surfactant is used, can be those that provide an acceptable level of foaming when used inside a dishwashing or warewashing machine. Detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

The detergent compositions can be provided in any of a variety of embodiments of detergent compositions. In an embodiment, the detergent composition may be substantially free of phosphorous, nitrilotriacetic acid (NTA) and ethylenediaminetetraacetic acid (EDTA). Phosphorus-free means a composition having less than approximately 0.5 wt %, more particularly, less than approximately 0.1 wt %, and even more particularly less than approximately 0.01 wt % phosphorous based on the total weight of the composition. NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent. When diluted to a use solution, the detergent composition includes phosphorous-containing components, NTA and EDTA concentrations of less than approximately 100 ppm, particularly less than approximately 10 ppm, and more particularly less than approximately 1 ppm.

Additional Functional Materials

The detergent compositions can also include various additional functional components. In some embodiments, the alkalinity source, water, and a surfactant or surfactant system make up a large amount, or even substantially all of the total weight of the detergent composition, for example, in embodiments having few or no additional functional materials disposed therein.

In alternative embodiments, functional materials are added to provide desired properties and functionalities to the detergent composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multi-functional and may also provide several of the functional benefits discussed below.

Secondary Alkali Source

The detergent composition can include one or more secondary alkali sources. Examples of suitable secondary alkali sources of the detergent composition include, but are not limited to alkali metal carbonates, alkali metal hydroxides and alkali metal silicates. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the detergent composition in any form known in the art, including as solid beads, dissolved in an aqueous solution, or a combination thereof. Examples of alkali metal silicates include, but are not limited to sodium or potassium silicate or polysoilicate, sodium or potassium metasilicate and hydrated sodium or potassium metasilicate or a combination thereof.

Builders or Water Conditioners

The detergent composition can include one or more building agents, also called chelating or sequestering agents (e.g., builders), including, but not limited to: condensed phosphates, alkali metal carbonates, phosphonates, aminocarboxylic acids, and/or polycarboxylic acids. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the solid detergent composition is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the detergent composition as water of hydration.

Examples of phosphonates include, but are not limited to: 2-phosphonobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine (pentamethylenephosphonic acid), $(HO_2)POCH_2N[(CH_2)_2N[CH_2PO(OH)_2]_2]_2$; and phosphorus acid, $H_3PO_3$. Preferred phosphonates include HEDP, PBTC, ATMP and combinations thereof. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the detergent composition is free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, tartaric acid, gluconic acid, acetic acid, benzoic acid, citric acid, formic acid, lactic acid, malic acid, glutamic acid, adipic acid, oxalic acid, maleic/olefin polymer, sulfonated polymer or terpolymer, acrylic/maleic polymer, polymethacrylic acid, acrylic acid-methacrylic acid polymers, hydrolyzed polyacrylamide, hydrolyzed polymethacrylamide, hydrolyzed polyamide-methacrylamide polymers, hydrolyzed polyacrylonitrile, hydrolyzed polymethacrylonitrile, and hydrolyzed acrylonitrile-methacrylonitrile polymers. Other suitable water conditioning polymers include starch, sugar or polyols comprising carboxylic acid or ester functional groups. Exemplary carboxylic acids include but are not limited to maleic acid, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The detergent compositions can also include a hardening agent in addition to, or in the form of, the builder. A hardening agent is a compound or system of compounds, organic or inorganic, which significantly contributes to the uniform solidification of the detergent composition. Preferably, the hardening agents are compatible with the cleaning agent and other active ingredients of the detergent composition and are capable of providing an effective amount of hardness and/or aqueous solubility to the processed detergent composition. The hardening agents should also be capable of forming a homogeneous matrix with the cleaning agent and other ingredients when mixed and solidified to provide a uniform dissolution of the cleaning agent from the detergent composition during use.

The amount of hardening agent included in the detergent composition will vary according to factors including, but not limited to: the type of detergent composition being prepared, the ingredients of the detergent composition, the intended use of the detergent composition, the quantity of dispensing solution applied to the solid detergent composition over time during use, the temperature of the dispensing solution, the hardness of the dispensing solution, the physical size of the detergent composition, the concentration of the other ingredients, and the concentration of the cleaning agent in the detergent composition. It is preferred that the amount of the hardening agent included in the detergent composition is effective to combine with the cleaning agent and other ingredients of the detergent composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of compositions comprising a polyethylene glycol hardening agent will vary, at least in part, according to the amount and the molecular weight of the polyethylene glycol added to the detergent composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight. In one embodiment, however, the solid controlled release composition if free of sulfates and carbonates including soda ash.

Urea particles can also be employed as hardeners in the detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the detergent compositions include, but are not limited to: chlorine-containing compounds such as chlorine, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount between approximately 0.1% and approximately 60% by weight, between approximately 1% and approximately 20% by weight, between approximately 3% and approximately 8% by weight, and between approximately 3% and approximately 6% by weight.

Fillers

The detergent composition can include an effective amount of detergent fillers which do not perform as a cleaning agent per se, but cooperates with the cleaning agent to enhance the overall cleaning capacity of the detergent composition. Examples of detergent fillers suitable for use in the present detergent compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the detergent composition. Examples of defoaming agents include, but are not limited to: ethylene oxide/propylene block polymers such as those available under the name Pluronic® N-3 available from BASF Corporation, Florham Park, N.J.; silicone compounds such as silica dispersed in polydimethylsiloxane, polydimethylsiloxane, and functionalized polydimethylsiloxane such as those available under the name Abil® B9952 available from Goldschmidt Chemical Corporation, Hopewell, Va.; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount between approximately 0.0001% and approximately 10% by weight, between approximately 0.001% and approximately 5% by weight, or between approximately 0.01% and approximately 1.0% by weight.

Anti-Redeposition Agents

The detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride polymers, cellulosic derivatives such as hydroxyethyl cellulose, hydroxypropyl cellulose and carboxymethyl cellulose. When the concentrate includes an anti-redeposition agent, the anti-redeposition agent can be included in an amount between approximately 0.5% and approximately 10% by weight, and between approximately 1% and approximately 5% by weight.

Stabilizing Agents

The detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

The detergent composition may also include dispersants. Examples of suitable dispersants that can be used in the detergent composition include, but are not limited to: maleic acid/olefin polymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the detergent composition include those enzymes that aid in the removal and/or antiredeposition of starch, protein, fats, oils and combinations thereof. Exemplary types of enzymes include, but are not limited to: proteases, alpha-amylases, lipases and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 15% by weight, between approximately 0.5% to approximately 10% by weight, and between approximately 1% to approximately 5% by weight.

Fragrances and Dyes

Various dyes, odorants including perfumes, and other aesthetic enhancing agents can also be included in the detergent composition. Suitable dyes that may be included to alter the appearance of the detergent composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the detergent compositions include, but are not limited to: terpenoids such as citronellol, aldehydes such as amyl cinnamaldehyde, a jasmine such as C1S-jasmine or jasmal, and vanillin.

Thickeners

The detergent compositions can include a rheology modifier or a thickener. The rheology modifier may provide the following functions: increasing the viscosity of the detergent compositions; increasing the particle size of liquid use compositions when dispensed through a spray nozzle; providing the use compositions with vertical cling to surfaces; providing particle suspension within the use compositions; or reducing the evaporation rate of the use compositions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas* campestras. Xanthan may be made by fermentation based on corn sugar or other corn sweetener by-products. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use composition that can produce large particle size mist or aerosol when sprayed.

Method of Use

A detergent is typically added to an automated dispenser or delivery device of an institutional warewashing or consumer dishwashing machine prior to the start of a cycle. An automated dispenser is a device which controls a composition's availability for contact with water such that a composition is only available for contact with water during a specified period of the cycle.

As described above, a cycle typically includes at least one wash cycle and at least one rinse cycle, with the number of wash and rinse cycles and the temperature and duration of each dependent on the cycle settings of the machine. During a wash cycle, detergent is automatically dispensed into the wash tub by, for example, an automated dispenser or delivery device and mixed with the wash water to form a use solution that is used to clean the wares in the wash tub. During the rinse cycle, the wares are contacted with water that is free of the detergent. An automated dispenser or delivery device is required to dispense the detergent at a specified stage of the cycle such that the detergent is only present during the wash cycle.

In contrast to the detergent, the current solid controlled release composition does not require an automated dispenser or delivery device to control the dispensing of the composition. For use, the current solid controlled release composition can be placed in the wash tub before the beginning of the cycle and may be available for contact with water throughout an entire cycle. The solid controlled release composition may be present in the wash tub throughout a complete cycle, and is preferably formulated to be present in the wash tub for more than one cycle. The current controlled release composition is formulated so that at least one active ingredient in the solid controlled release composition dissolves or disperses when contacted with water, such that the solid controlled release composition does not require an automated dispenser or delivery device to control the dispensing of the active ingredient.

When a detergent and the solid controlled release composition are used in conjunction, water mixes with the solid controlled release composition and the detergent during at least one wash cycle and forms an aqueous mixture of the active ingredient(s) of the solid controlled release composition and the alkalinity source of the detergent. During the rinse cycle, water contacts only the solid controlled release composition to form an aqueous mixture of the active ingredient(s). In certain cycles, water contacts the solid controlled release composition before contacting the detergent. For example, water may contact the solid controlled release composition to form a use solution and wares may be contacted with this use solution before the detergent is added to the wash tub.

The solid controlled release composition can release the active ingredient over multiple wash cycles. In one example, the solid controlled release composition is formulated to release the active ingredient over a period of two or more wash cycles, and preferably over a period of at least 100 wash cycles. The rate at which the active ingredient is dispersed can be modified by adjusting the composition of the solid controlled release composition, increasing or decreasing the size of the solid controlled release composition, changing the amount of surface area exposed to water, positioning the controlled solid release composition in different spaces inside the wash tub, or adjusting the cycle settings, such as but not limited to the water temperature and cycle duration. For example, increasing the weight percentage of cellulosic material may decrease the rate at which the active ingredient is dispersed, increasing the number of wash cycles the solid controlled release composition may be used before requiring replacement.

The solid controlled release composition may be in the form of a solid such as a block, tablet or capsule. In one example, a holder supports and holds the solid controlled release composition inside the wash tub of the warewashing machine. Preferably, the holder minimally impacts water contact with the solid controlled release composition. Suitable holders include mesh bags, baskets, cases or cages. Further suitable holders include hooks or platforms which are embedded or molded in the solid controlled release composition to attach the solid controlled release composition to the inside of the warewashing machine.

The sole FIGURE is a perspective view of example holder 10 located in wash tub 12 of a warewashing machine. Portions of wash tub 12 have been broken away. Hanger 14 secures holder 10 to a support of the warewashing machine. Solid controlled release tablet 16 is placed within holder 10. Holder 10 can have any suitable shape which supports solid controlled release tablet 16. For example, holder 10 can have a bottom and sides and an open top. Holder 10 is configured to allow water to enter and exit. For example, holder 10 may be formed from a mesh in which voids allow water to enter and exit the holder. In use, water enters holder 10 and contacts solid controlled release tablet 16 which releases a portion of the active ingredient into the water to form a use solution. The use solution leaves holder 10 and contacts wares in the wash tub. Holder 10 is strong enough to support controlled release tablet 16 while allowing a sufficient amount of water to contact solid controlled release tablet 16.

The holder can be removably or non-removably attached to the solid controlled release composition. In one example, the holder is a cage, basket, net, cartridge or case which supports the solid controlled release composition while allowing water to contact a large portion of the composition. In another example, adhesive can attach the holder to the solid controlled release composition. In a further example, controlled release composition is molded around the holder. The holder can have perforations, holes or voids to enable water to contact a large portion of the composition and to enable the use solution to dispense from the holder.

The holder supports the solid controlled release composition inside the warewashing machine. For example, adhesive may attach the holder to the inside of the warewashing machine. Additionally or alternatively, the holder may attach to the inside of the wash tub by clips, hooks, suction cups, strings, ropes or other fastening devices. Structures within the warewashing machine may also be used to support the holder. For example, the solid controlled release composition may be directly fastened to the machine housing or a structure within the machine design. Furthermore, the solid controlled release composition may be directly or indirectly held or fastened to removable parts associated with the warewashing or dishwashing machine, including but not limited to inserts, racks, baskets, dishware, plasticware, utensils and the like.

The current controlled release composition may be packaged and sold with a discrete detergent as a system. In such a system, the solid controlled release composition and the quantity of detergent may be calculated to provide for about the same number of wash cycles. Providing the current controlled release composition and the detergent as a packaged system also allows the solid controlled release composition and the detergent to be formulated to complement one another and provide enhanced cleaning and scale control. Alternatively, the current controlled release composition may be packaged and sold separate from the discrete detergent.

In one example, the detergent is substantially free of the active ingredient of the solid controlled release composition. Providing a separate solid controlled release composition and detergent enables water to contact the active ingredient before the detergent is introduced to the wash tub during the wash cycle.

In another example, the solid controlled release composition is essentially free of an alkalinity source, and under some cycle settings, the active ingredient contacts the wares before an alkalinity source contacts the wares. Enhanced performance may be seen when the active ingredient is applied to wares before the detergent is introduced to the wares.

Further, the solid controlled release composition may include an active ingredient that may be sensitive to the concentrate detergent composition, and enhanced performance may be seen when the active ingredient and the alkalinity source are only contacted with one another in an aqueous solution. For example, the solid controlled release composition may include an active ingredient sensitive to high pH. Providing a discrete or separate solid controlled release composition prevents exposing the sensitive active ingredient to the detergent composition until both compositions are dissolved or dispersed in the use solution.

Still further, discrete solid controlled release compositions can boost the effectiveness of existing detergents, eliminating the need to reformate existing detergents and allowing existing detergents to be matched with a solid controlled release composition to tailor the desired cleaning. For example an existing detergent may be used with a solid controlled release composition containing an anti-scale agent in an application with hard water and high scale.

Methods of Manufacture

In general the solid controlled release composition of the present invention can be created by combining the at least one cellulosic material, water, at least one active ingredient and optionally at least one saccharide, sugar alcohol or salt and allowing the components to interact.

In one example, the at least one cellulosic material, water, at least one active ingredient, and optionally at least one saccharide, sugar alcohol or salt are mixed and are pressed into a solid form. In a specific example, the solid controlled release tablet was pressed for 1 minute at 2000 psi and could be used immediately.

In another example, the components are mixed and harden into a solid form. The solidification process can last from a few minutes to about six hours depending on factors such as but not limited to: the size of the formed or cast composition, the ingredients of the composition, and the temperature of the composition.

The solid controlled release compositions may be formed using a batch or continuous mixing system. In an exemplary embodiment, a single- or twin-screw extruder is used to combine and mix one or more ingredients at high shear to form a homogeneous mixture. In some embodiments, the process mixture may be dispensed from the mixture by forming, casting, or other suitable means, whereupon the composition hardens to a solid form. The structure of the matrix may be characterized according to its hardness, melting point, material distribution, crystal structure, and other like properties according to known methods in the art. Generally, a solid controlled release composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast controlled release composition begins to harden to a solid form in between approximately 1 minute and approximately 3 hours. Particularly, the cast controlled release composition begins to harden to a solid form in between approximately 1 minute and approximately 2 hours. More particularly, the cast controlled release composition begins to harden to a solid form in between approximately 1 minute and approximately 20 minutes.

By the term "solid", it is meant that the hardened solid controlled release composition will not flow and will substantially retain its shape under moderate stress or pressure or mere gravity. The degree of hardness of the solid controlled release composition may range from that of a fused solid product which is relatively dense and hard, for example, like concrete, to a consistency characterized as being a hardened paste. In addition, the term "solid" refers to the state of the solid controlled release composition under the expected conditions of storage and use of the solid composition. In general, it is expected that the solid controlled release composition will remain in solid form when exposed to temperatures of up to approximately 100° F. and particularly up to approximately 120° F.

The resulting solid controlled release composition may take forms including, but not limited to: a cast solid product, and an extruded, pressed, molded or formed solid capsule, block or tablet.

The solid controlled release composition can be provided for industrial cleaning in the form of a multiple-use solid, such as a capsule, block or tablet, and can be repeatedly used to generate aqueous compositions for multiple washing cycles. For example, the solid controlled release composition can be used for general aqueous compositions for greater than 50 washing cycles, for greater than 75 washing cycles, and for greater than 100 washing cycles. The control release composition can also be provided for consumer cleaning applications in the form of a multi-use solid, such as a capsule, block or tablet, and can be repeatedly used to generate aqueous compositions for multiple washing cycles. For example, the solid controlled release composition can be used for general aqueous compositions for equal to or greater than 2 washing cycles.

In certain embodiments, the solid controlled release composition is provided as a cast solid, an extruded block, or a tablet having a mass of between approximately 5 grams and approximately 1 kilogram. In further embodiments, the solid controlled release composition has a mass between approximately 10 grams and approximately 500 grams. In still further embodiments, the solid controlled release composition has a mass of between approximately 10 grams and about approximately 200 grams.

The detergent and the solid controlled release composition can be manufactured separately. The detergent can be manufactured according to procedures known in the art. The detergent can take on the forms including but not limited to: a cast solid product; an extruded, molded or formed solid pellet, block, tablet, powder, granule, flake; a paste; and a liquid. In one example, the detergent can be provided in the form of a solid unit dose. A unit dose refers to a composition unit sized so that the entire unit is used during a single washing cycle. When the detergent composition is provided as a solid unit dose, it is typically provided as a cast solid, an extruded pellet, or a tablet having a size of between approximately 1 gram and approximately 50 grams.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight bases, and all reagents used in the examples were obtained, or are available, from the chemical suppliers described below, or may be synthesized by conventional techniques.

Materials Used

Belclene® 810: A maleic acid terpolymer, 50% active, available from BWA Water Additives, Tucker, Ga.

Acumer™ 1000: an acrylic acid homopolymer, 48% active, available from Dow Chemical, Midland, Mich.

Solid Power® XL: a solid warewashing detergent available from Ecolab Inc, St. Paul, Minn.

Experiment 1

Multicycle Warewashing Test

The multicycle warewashing test was designed to evaluate hard water scale accumulation on glass and plastic surfaces. First, six Libby 10 oz. glass tumblers were prepared by removing all film and foreign material from the surfaces of the tumblers. A Hobart AM-14 institutional warewashing machine was then filled with an appropriate amount of water and the water was tested for hardness. After recording the hardness value, the tank heaters were turned on. On the day of the experiments, the water hardness was 17 grains (1 grain=17 parts-per-million).

A plastic, mesh basket for the solid controlled release composition was attached to the rack supports in the back, lower, left hand corner of the warewashing machine using a zip tie. The solid controlled release solid (if used) was placed inside the mesh basket and the machine was filled with 17 grain water. The solid controlled release solid was contacted with water throughout the filling process. Once the machine was filled, the wash temperature was allowed to equilibrate to 150-160° F. The controller was then set to dispense an appropriate amount of detergent into the wash tank. The detergent was dispensed such that when the detergent was mixed with water during the cycle to form a use solution, the use solution contained a predetermined detergent concentration. The warewashing machine had a washbath volume of 60 liters, a rinse volume of 4.5 liters, a washtime of 50 seconds, a rinse time of 9 seconds and rinse temperature between about 175-190° F.

When used, the solid controlled release tablet was present in the warewashing machine during the initial fill and each cycle of a particular multicycle test. Further, when used, the same solid controlled release tablet was present the duration of the test; the solid controlled release tablet was not removed or replaced during a multicycle test.

The six clean glass tumblers were placed diagonally in a Raburn rack (see arrangement below) and one Newport 10 oz. plastic tumbler was placed off-diagonal. (G=glass tumbler; P=plastic tumbler). The rack was placed inside the warewashing machine.

| | | | | | |
|---|---|---|---|---|---|
| | | | | | G |
| | | | | G | |
| | | | G | | |
| | | G | | | |
| | G | | | P | |
| G | | | | | |

The multicycle test was then started. At the beginning of each wash cycle, the appropriate amount of detergent was automatically dispensed into the warewashing machine to maintain the initial detergent concentration. The detergent concentration was controlled by conductivity. Concomitantly, the control release solid was contacted with wash and rinse water throughout the duration of the multicycle test.

Upon completion of all cycles, the rack was removed from the warewashing machine and the glass and plastic tumblers were allowed to dry. The glass and plastic tumblers were then graded for hard water scale accumulation using an analytical light box evaluation. The light box test used a digital camera, a light box, a light source, a light meter and a control computer employing "Spot Advance" and "Image Pro Plus" commercial software. A glass to be evaluated was placed on its side on the light box, and the intensity of the light source was adjusted to a predetermined value using the light meter. A photographic image of the glass was taken and saved to the computer. The software was then used to analyze the upper half of the glass, and the computer displayed a histogram graph with the area under the graph being proportional to the thickness of the film.

Generally, a lower light box score indicates that more light was able to pass through the tumbler. Thus, the lower the light box score, the more effective the composition was at preventing scale on the surface of the tumbler.

Samples 1-2 and Comparative Samples A-B

Samples 1-2 and Comparative Samples A-B investigated controlled release tablets in combination with alkali metal hydroxide detergents. The solid controlled release tablets were formed by mixing the components according to Table 1 until uniform and then pressing the composition at 2000 psi for 1 minute using a Carver Press and a 2" die. The tablets were used immediately.

TABLE 1

| Controlled release tablet | | | | |
|---|---|---|---|---|
| | Sample 1 | Sample 2 | Comp. Smpl. A | Comp. Smpl. B |
| Carboxymethyl cellulose (CMC) | 68.7 g | 68.7 g | 0 | 0 |
| Sucrose | 5.2 g | 5.2 g | 0 | 0 |
| Water | 20 g | 0 | 0 | 0 |
| Belclene 810 | 0 | 40 g | 0 | 0 |
| **Cast solid detergent** | | | | |
| | Sample 1 | Sample 2 | Comp. Smpl. A | Comp. Smpl. B |
| Sodium hydroxide beads | 75% | 75% | 75% | 75% |
| Water | 25% | 25% | 25% | 12% |
| Belclene 810 | 0% | 0% | 0% | 13% |

The use solution concentration of the detergent, the number of cycles and the light box scores are presented in Table 2.

TABLE 2

| | Concentration of detergent in use solution | Number of cycles | Sum of glass scores | Sum of plastic scores | Sum of combined scores |
|---|---|---|---|---|---|
| Sample 1 | 667 ppm | 85 | 388204 | 51491 | 439695 |
| Sample 2 | 667 ppm | 96 | 167080 | 37854 | 204934 |
| Comp. Sample A | 667 ppm | 96 | 393210 | 65535 | 458745 |
| Comp. Sample B | 667 ppm | 96 | 190950 | 48832 | 239782 |

Sample 1, which included a detergent and a solid controlled release tablet with no maleic acid polymer (Belclene 810), had a lower light box score than Comparative Sample A, which included a detergent and no maleic acid polymer. Sample 2, which included a detergent and a controlled release tablet with a maleic acid polymer, had a lower light box score than Comparative Sample B, which included a detergent with a maleic acid polymer. The results show that a maleic acid polymer can be removed from an alkali metal hydroxide detergent and placed in the solid controlled release tablet without sacrificing anti-scale performance.

Samples 3-4 and Comparative Samples C-D

Samples 3-4 and Comparative Samples C-D investigated using controlled release tablets with sodium carbonate detergents. Samples 3-4 and Comparative Samples C-D used the solid controlled release tablets and solid cast detergents indicated in Table 3. The solid controlled release tablets were formed by mixing the components until uniform and then pressing at 2000 psi for 1 minute.

TABLE 3

| Controlled release tablet | | | | |
|---|---|---|---|---|
| | Sample 3 | Sample 4 | Comp. Smpl. C | Comp. Smpl. D |
| Carboxymethyl cellulose (CMC) | 68.7 g | 68.7 g | 0 | 0 |
| Sucrose | 5.2 g | 5.2 g | 0 | 0 |
| Water | 20 g | 0 | 0 | 0 |
| Belclene 810 | 0 | 40 g | 0 | 0 |
| **Cast solid detergent** | | | | |
| | Sample 3 | Sample 4 | Comp. Smpl. C | Comp. Smpl. D |
| Sodium carbonate | 75% | 75% | 75% | 75% |
| Water | 25% | 25% | 25% | 8% |
| Belclene 810 | 0% | 0% | 0% | 17% |

The use solution concentration of the detergent, the number of cycles and the light box scores are presented in Table 4.

TABLE 4

| | Concentration of detergent in use solution | Number of cycles | Sum of glass scores | Sum of plastic scores | Sum of combined scores |
|---|---|---|---|---|---|
| Sample 3 | 1000 ppm | 97 | 393210 | 57683 | 450893 |
| Sample 4 | 1000 ppm | 113 | 117233 | 27414 | 144647 |
| Comp. Sample C | 1000 ppm | 113 | 393210 | 65535 | 458745 |
| Comp. Sample D | 1000 ppm | 113 | 146197 | 32461 | 178658 |

Sample 4, which included a detergent and a solid controlled release tablet containing Belclene 810, had a lower light box score than Comparative Sample D, which included a detergent containing Belclene 810. The results show that Belclene 810 can be removed from a sodium carbonate detergent and placed in the solid controlled release tablet without sacrificing anti-scale performance.

Sample 5 and Comparative Example E

Once it was determined that Belclene 810 could be removed from the detergent and placed in a solid controlled release tablet without sacrificing performance, Acumer 1000, an acrylic acid homopolymer, was investigated. Sample 5 and Comparative Sample E used the solid controlled release tablets and detergents indicated in Table 5. The solid controlled release tablet of Sample 5 included sodium sulfate.

TABLE 5

| Controlled release tablet | | |
|---|---|---|
| | Sample 5 | Comp. Smpl. E |
| Carboxymethyl cellulose (CMC) | 28 g | 0 |
| Sodium sulfate | 40 g | 0 |
| Acumer 1000 | 40 g | 0 |
| **Cast solid detergent** | | |
| | Sample 5 | Comp. Smpl. E |
| Sodium carbonate | 75% | 75% |
| Water | 25% | 25% |
| Belclene 810 | 0% | 0% |

The results are presented in Table 6.

TABLE 6

| | Concentration of detergent in use solution | Number of cycles | Approx. % of tablet remaining | Sum of glass scores | Sum of plastic scores | Sum of combined scores |
|---|---|---|---|---|---|---|
| Sample 5 | 750 ppm | 100 | <5% | 83678 | 65535 | 149213 |
| Comp. Sample E | 750 ppm | 100 | N/A | 393210 | 65535 | 458745 |

The results show Sample 5, which included a detergent and a solid controlled release tablet containing an acrylic acid polymer and sodium sulfate, had a lower light box score than Comparative Sample E, which only contained a detergent. That is, Sample 5 was more effective at preventing scale on the tumblers than Comparative Sample E.

Samples 6-7 and Comparative Sample F

Solid controlled release tablets were investigated in combination with a commercially available dishmachine detergent. Comparative Sample F only used Solid Power XL, a commercially available dishmachine detergent. Samples 6 and 7 used the solid controlled release tablets of Table 7 in combination with Solid Power XL. The results are presented in Table 8.

TABLE 7

| Controlled release tablet | | | |
|---|---|---|---|
| | Sample 6 | Sample 7 | Comp. Smpl. F |
| Carboxymethyl cellulose (CMC) | 68.7 g | 68.7 g | 0 |
| Sucrose | 5.2 g | 5.2 g | 0 |
| Belclene 810 | 40 g | 20 g | 0 |
| **Cast solid detergent** | | | |
| | Sample 6 | Sample 7 | Comp. Smpl. F |
| Solid Power XL | 100% | 100% | 100% |

TABLE 8

| | Concentration of detergent in use solution | Number of cycles | Approx. % of tablet remaining | Sum of glass scores | Sum of plastic scores | Sum of combined scores |
|---|---|---|---|---|---|---|
| Sample 6 | 750 ppm | 100 | 30%-40% | 142610 | 28314 | 170924 |
| Sample 7 | 750 ppm | 100 | 20%-30% | 186265 | 34092 | 220357 |
| Comp. Sample F | 750 ppm | 100 | N/A | 217720 | 32856 | 250576 |

Samples 6 and 7, which each included a controlled release tablet, had lower light box scores than Comparative Sample F, which only included Solid Power XL detergent. That is, Samples 6 and 7 were more effective at preventing scale than Comparative Sample F.

Samples 8-9 and Comparative Sample G

Samples 8-9 and Comparative Sample G investigated the incorporation sucrose and sodium sulfate. The solid controlled release tablets and cast solid detergents of Samples 8-9 and Comparative Sample G are presented in Table 9.

TABLE 9

| Controlled release tablet | | | |
|---|---|---|---|
| | Sample 8 | Sample 9 | Comp. Smpl. G |
| CMC | 68.7 g | 30 g | 0 |
| Sucrose | 5.2 g | 5.2 g | 0 |
| Belclene 810 | 40 g | 40 g | 0 |
| Sodium sulfate | 0 | 40 g | 0 |
| **Cast solid detergent** | | | |
| | Sample 8 | Sample 9 | Comp. Smpl. G |
| Water | 25 g | 25 g | 17.8 g |
| NaOH | 75 g | 75 g | 70.1 g |
| Belclene 810 | 0 | 0 | 12.1 g |
| Use conc. | 0.667 g/L | 0.667 g/L | 0.713 g/L |

The light box results are presented in Table 10. Samples 8 and 9 each included 40 ppm Belclene 810 in the solid controlled release tablet. The difference was that Sample 8 included sucrose while Sample 9 included sucrose and sodium sulfate.

TABLE 10

| | Number of cycles | Approx. amount of tablet remaining | Sum of glass scores | Sum of plastic scores | Sum of combined scores |
|---|---|---|---|---|---|
| Sample 8 | 100 | 29.39 g | 85422 | 65535 | 150957 |
| Sample 9 | 100 | 9.00 g | 182029 | 65535 | 247564 |
| Comp. Smpl. G | 100 | N/A | 107988 | 49911 | 157899 |

Samples 8 and 9 were both effective at preventing scale, although Sample 9 was less effective at preventing scale than Comparative Sample G, which did not use a controlled release tablet.

Additionally, Sample 9, which included sodium sulfate, had an increased dispensing rate compared to Sample 8. The solid controlled release tablet of Sample 8 dispensed 84.51 grams in 100 cycles while the solid controlled release tablet of Sample 9 dispensed 106.2 grams in 100 cycles.

Samples 10-14

Samples 10-14 show that other sugars and salts may be present in the controlled release composition without sacrificing performance.

TABLE 11

| Controlled release tablet | | | | | |
|---|---|---|---|---|---|
| | Sample 10 | Sample 11 | Sample 12 | Sample 13 | Sample 14 |
| Carboxymethyl cellulose (CMC) | 68.7 g | 68.7 g | 68.7 g | 68.7 g | 68.7 g |
| Sucrose | 5.2 g | 0 | 0 | 0 | 5.2 g |
| Sorbitol | 0 | 0 | 5.2 | 0 | 0 |
| Water | 40 g | 0 | 0 | 0 | 0 |

TABLE 11-continued

| | | | | | |
|---|---|---|---|---|---|
| Sodium Chloride | 0 | 0 | 0 | 5.2 g | 0 |
| Acumer 1000 | 0 | 40 g | 40 g | 40 g | 40 g |

| Cast solid detergent | | | | | |
|---|---|---|---|---|---|
| | Sample 10 | Sample 11 | Sample 12 | Sample 13 | Sample 14 |
| Sodium carbonate | 75% | 75% | 75% | 75% | 75% |
| Water | 25% | 25% | 25% | 25% | 25% |
| Acumer 1000 | 0% | 0% | 0% | 0% | 0% |
| Use concentration | 0.667g/L | 0.667g/L | 0.667g/L | 0.667g/L | 0.667g/L |

The results are presented in Table 12.

TABLE 12

| | Number of cycles | Sum of glass scores | Sum of plastic scores | Sum of combined scores |
|---|---|---|---|---|
| Sample 10 | 90 | 368323 | 54679 | 423002 |
| Sample 11 | 90 | 67869 | 47046 | 114915 |
| Sample 12 | 90 | 107601 | 39637 | 147238 |
| Sample 13 | 90 | 78659 | 52547 | 131206 |
| Sample 14 | 90 | 112312 | 50348 | 162660 |

Samples 10-14 each had lower light box scores compared to both the positive (Sample 14) and negative (Sample 10) controls. The results show that sucrose, sorbitol, and sodium chloride may be used in the controlled release composition without sacrificing anti-scaling performance.

Multicycle Automatic Dishwashing Test—5 Cycles

The multicycle automatic consumer dishwashing test is designed to evaluate hard water scale accumulation on various substrates. The multicycle automatic dishwashing tests were performed using a Maytag Jetclean, portable tall tub consumer dishwasher (Model #MDC4809AWB) operating in the normal cycle without heated drying. The 5 grain water used for all experiments was preheated with a booster heater prior to entering the machine to ensure uniform temperature throughout all experiments (125° F.). Six clean Libbey glass tumblers and one one Newport 10 oz. plastic tumbler were placed in a Raburn rack (see arrangement below). (G=glass tumbler; P=plastic tumbler). The rack was placed inside the warewashing machine.

| | | | | |
|---|---|---|---|---|
| G | | | | G |
| | G | | G | |
| G | | P | | G |

Detergent, in an amount of 30 grams, was placed in the detergent dispenser and the lid was placed in the closed position. The solid controlled release tablet was placed in a plastic, mesh bag which was secured to the top rack of the dishwashing machine. The dishwasher was then started using the normal cycle without heated drying. Four additional cycles were completed (without drying in between each cycle) with the appropriate amount of detergent added in between each cycle. Upon completion of 5 cycles, the glasses were removed from the dishwasher and allowed to dry overnight. The glasses were then graded using the lightbox evaluation test. The solid controlled release tablet was present in the dishwashing machine during the initial fill and each cycle of a particular multicycle test. Furthermore, when used, the solid controlled release tablet was present during the duration of the test; the solid controlled release tablet was not removed or replaced during the multicycle test.

TABLE 13

| Controlled Release Tablet | | | | |
|---|---|---|---|---|
| | Sample 15 | Sample 16 | Sample 17 | Sample 18 |
| Carboxymethyl cellulose | 0 | 75 | 75 | 55 |
| Belclene 810, 50% | 0 | 0 | 0 | 40 |
| Sucrose | 0 | 5 | 5 | 5 |
| DI water | 0 | 20 | 20 | 0 |

| Solid Detergent | | | | |
|---|---|---|---|---|
| | Sample 15 | Sample 16 | Sample 17 | Sample 18 |
| Sodium Silicate (2.4SiO2:Na2O) | 20 | 20 | 20 | 20 |
| Dense Sodium Carbonate | 40 | 40 | 40 | 40 |
| Belclene 810, 50% | 0 | 0 | 3.2 | 0 |
| Plurafac 25R2 | 0.5 | 0.5 | 0.5 | 0.5 |
| CDB56 | 2 | 2 | 2 | 2 |
| Sodium Sulfate | 37.5 | 37.5 | 34.3 | 37.5 |

The test results are provided in Table 14.

TABLE 14

| | SUM light box scores (glasses) | SUM light box scores (plastic) | SUM light box scores (total) |
|---|---|---|---|
| Sample 15 | 387138 | 65535 | 452673 |
| Sample 16 | 393210 | 45266 | 438476 |
| Sample 17 | 88582 | 18612 | 107194 |
| Sample 18 | 102042 | 65121 | 167163 |

Sample 17 utilized a water conditioning polymer in the controlled release solid in combination with a solid detergent composition without polymer. Sample 17 performed better than negative controls (Samples 15 and 16) and slightly worse than solid detergent/controlled release combination with the water conditioning polymer in the solid detergent (Sample 18). The results show that the water conditioning polymer may be removed from the solid detergent composition and placed in the solid controlled release composition.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A system for cleaning wares, the system comprising:

a solid controlled release composition having a substantially homogenous composition and consisting essentially of at least one cellulosic material, water, at least one polycarboxylic acid, and optionally at least one member selected from the group consisting of saccharides, sugar alcohols, and salts; and a discrete detergent composition comprising at least one alkalinity source, wherein the solid controlled release composition is substantially free of an alkalinity source, is in the form of a multiple-use solid, and releases the at least one polycarboxylic acid over multiple wash cycles; and wherein the discrete detergent composition is substantially free of the at least one polycarboxylic acid of the solid controlled release composition.

2. The system of claim 1, wherein the at least one polycarboxylic acid comprises maleic acid polymer, maleic anhydride polymer, methacrylic acid polymer, acrylic acid polymer, itaconic acid polymer, or a derivative thereof.

3. The system of claim 1, wherein the solid controlled release composition consists essentially of at least one cellulosic material, water, at least one polycarboxylic acid, at least one saccharide, and at least one salt.

4. The system of claim 1, wherein the at least one cellulosic material is present in an amount of between about 5% and about 90% by weight of the solid composition, water is present in an amount of between about 0.5% and about 60% by weight of the solid composition, and the at least one carboxylic acid present in an amount of between about 0.1% and about 40% by weight of the solid composition.

5. The system of claim 1, the system further comprising:

a holder configured to hold the solid composition and configured to be secured to a wash tub of a warewashing or dishwashing machine.

6. The system of claim 5, wherein the holder comprises a mesh, basket, cage, net, cartridge or case.

7. The system of claim 5, wherein the holder is removably attachable to the wash tub.

8. The system of claim 5, wherein the holder is not an automated dispenser or delivery device.

* * * * *